United States Patent [19]

Acevedo

[11] 3,959,828

[45] June 1, 1976

[54] FLUSH VALVE AND OVERFLOW PIPE ASSEMBLY FOR A TOILET TANK

[76] Inventor: Ignacio Acevedo, 4066 Fenwick Road, Columbus, Ohio 43220

[22] Filed: Apr. 9, 1975

[21] Appl. No.: 566,215

[52] U.S. Cl. ..... 4/57 P; 4/62

[51] Int. Cl.[2] ..... E03D 1/34

[58] Field of Search ..... 4/57 R, 57 P, 67 A, 4/67 P, 37, 34, 60, 62

[56] References Cited

UNITED STATES PATENTS

| | | | |
|---|---|---|---|
| 2,773,268 | 12/1956 | Hurko | 4/57 P |
| 3,142,846 | 8/1964 | Lackenmaier | 4/62 |
| 3,302,217 | 2/1967 | Schrock | 4/57 P |
| 3,325,828 | 6/1967 | Alexander | 4/60 |

*Primary Examiner*—Henry K. Artis

*Attorney, Agent, or Firm*—Mahoney, Miller & Stebens

[57] ABSTRACT

A valve assembly for the control of discharge through the flush-water outlet of a tank for toilets or of other liquid storage tanks. It includes a flexible ball and float combination pivotably supported on the overflow tube in the tank for vertical swinging movement and so as to occupy a minimum amount of the limited space in the tank. In addition, it includes counterweight means in the form of a pair of water containers mounted on opposite sides of the pivoted support which fill with water from the tube so that when the valve support is swung into upper opening position, they will hold the support in that position with the valve unseated, to permit discharge of substantially all the water from the tank, but are provided with small metering discharge openings which gradually drain the containers until the weight of the valve and associated parts will cause it to drop into closed sealing position relative to the outlet.

9 Claims, 4 Drawing Figures

FLUSH VALVE AND OVERFLOW PIPE ASSEMBLY FOR A TOILET TANK

BACKGROUND OF THE INVENTION

Many different types of toilet flush valve and overflow pipe assemblies have been provided in the prior art. Some of them have included ball valves, but the valves have not been of such form as to provide sufficient flexibility for effective sealing on their cooperating seats as well as sufficient buoyancy to act as floats in aiding in unseating and movement to opened position. One type of prior art flush valves has also included a single small water container which is intended to act as a counterbalance when the valve is opened and to provide a time-delay as it slowly drains and eventually permits the valve to close. However, the usual container of this type is mounted so as to produce an imbalance in the assembly which interferes with the pivoting of the valve support and, moreover usually interferes with the overflow pipe and occupies too much of the limited space.

SUMMARY OF THE INVENTION

The present invention provides an overflow pipe of substantially L-form which is integrally connected at its horizontal lower end portion to a tubular sleeve fitting to be clamped in the flush-water outlet of the tube, to locate the upstanding portion of the pipe closely adjacent the rear wall of the tank. A valve seat is provided at the upper end of the tubular sleeve fitting and a ball type float and valve combination is adapted to be seated and unseated relative thereto. The valve includes a flexible skirt for effective seating on the seat. This valve and float combination is carried by a support plate which is pivoted to the forward side of the upstanding pipe portion for vertical swinging movement. The plate carries, at each side of the valve, small counterbalancing water containers which have forward open ends and metering drain openings in their substantially closed rear ends, which, with the valve seated, are disposed longitudinally in parallel relationship. As the support plate is swung upwardly to open the valve, the counterbalance containers move into almost upright positions at each side of the upstanding portion of the overflow pipe. Due to their shape and positions, they will provide counterweight to hold the valve open, during a predetermined time delay, to permit discharge of substantially all the water from the flush tank, but eventually will drain and permit the weight of the parts carried by the support plate to cause the valve to drop onto its seat.

BRIEF DESCRIPTION OF THE DRAWINGS

The best mode contemplated in carrying out this invention is illustrated in the accompanying drawings in which.

DETAILED DESCRIPTION OF THE INVENTION

Figure 1:
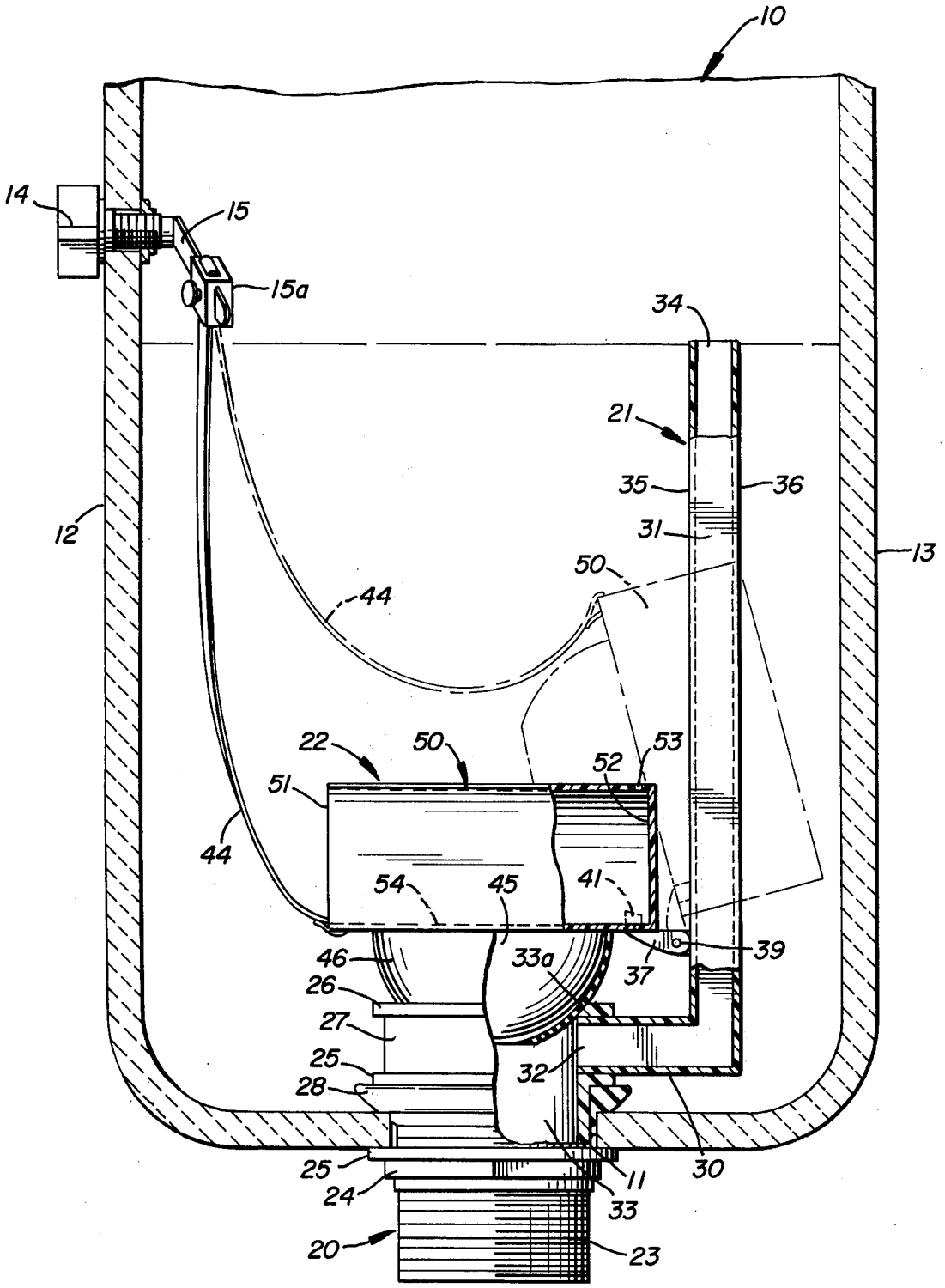
FIG. 1 is a vertical sectional view through a toilet flush tank showing the assembly of this invention mounted therein, with parts cut away for clarity.

With reference to FIG. 1, more in detail, the flush valve and overflow pipe assembly of this invention is shown inserted in the water tank 10 of a toilet which has a downwardly-opening discharge outlet 11 in its bottom. The outlet 11 is substantially midway of the upright front wall 12 and upright back wall 13 of the tank and is located laterally of the tube as required. The front wall of the tank carries an actuating lever 14 at its exterior surface which is pivoted for vertical rocking movement and which carries an arm 15 internally of the tank for simultaneous vertical rocking movement.

The complete assembly of this invention is made separately from the tank and is mounted as a unit therein. It consists generally of a tubular fitting 20 to be mounted in the opening 11, an overflow pipe 21 fixed to said fitting, and a valve-carrying unit 22 pivoted to the overflow pipe for vertical swinging movement. All parts are preferably made of a suitable plastic so as to resist corrosion The fitting 20 includes a lower threaded portion 23 which is used in mounting the tank on the toilet bowl and upon which a large nut 24 is threaded. Above the threaded portion is formed the vertically spaced lower and upper peripheral flanges 25 and 26 which provide an annular groove 27 therebetween. Directly below the flange 25, an annular gasket 28 is provided on the fitting and has a flat upper surface which engages the lower flat surface of the flange 25 and an outer surface which tapers downwardly and inwardly.

The threaded depending portion 23 of the fitting is passed downwardly through the outlet with the gasket 28 upwardly in place against the flange 25 and resting on the bottom of the tank 10. The nut 24 is threaded upwardly on the portion 23 until it engages the bottom of the tank and draws the fitting axially downwardly until the gasket 28 is sufficiently compressed to form an effective seal around the outlet 11. The assembly can be readily removed by screwing off the nut 24 and withdrawing the fitting upwardly into the tank.

Figure 4:
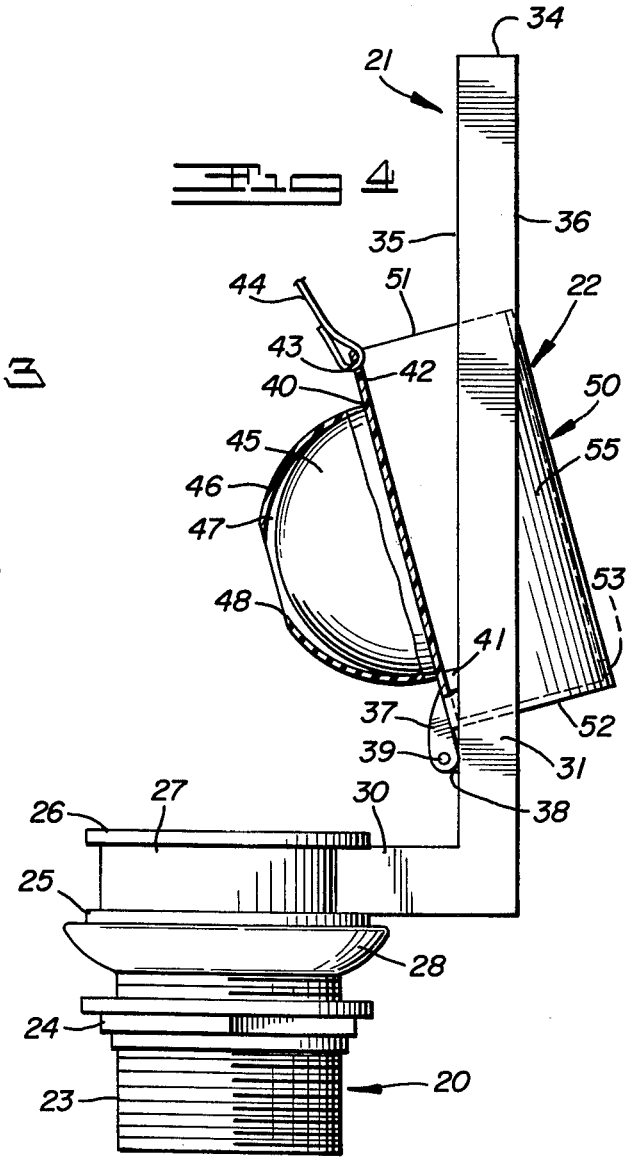
FIG. 4 is a side elevational view at ninety degrees relative to that of FIG. 4, with parts cut away for clarity.

The overflow pipe 21 is of substantially L-form having a lower radially inwardly extending branch 30 and an upstanding branch 31. The branch 30 extends inwardly into the groove 27 and is fixed between the flanges 25 and 26. Its inner extremity communicates with an opening 32 leading laterally into the fitting into communication with the vertical passage 33 of the fitting. A valve seat 33a is formed around the upper end of passage 33. The branch 30 leads rearwardly towards the back wall 13 of the tank, when the assembly is properly mounted, and the upstanding branch 31 is disposed parallel to the back wall. Preferably, the overflow pipe is of rectangular cross-section with an open upper inlet end 34. It is so located that its axis is vertical and its forward and rearward walls (FIG. 4) 35 and 36 are the wider sides and are disposed parallel to each other and in upright parallel relationship to the inner surface of the back wall 13 of the tank. The rectangular crosssection of the upright branch 31 of the overflow pipe is important so as to obtain sufficient capacity and still have it properly located in the limited space between the outlet 11 and back wall 13 of the tank 10.

Figure 2:
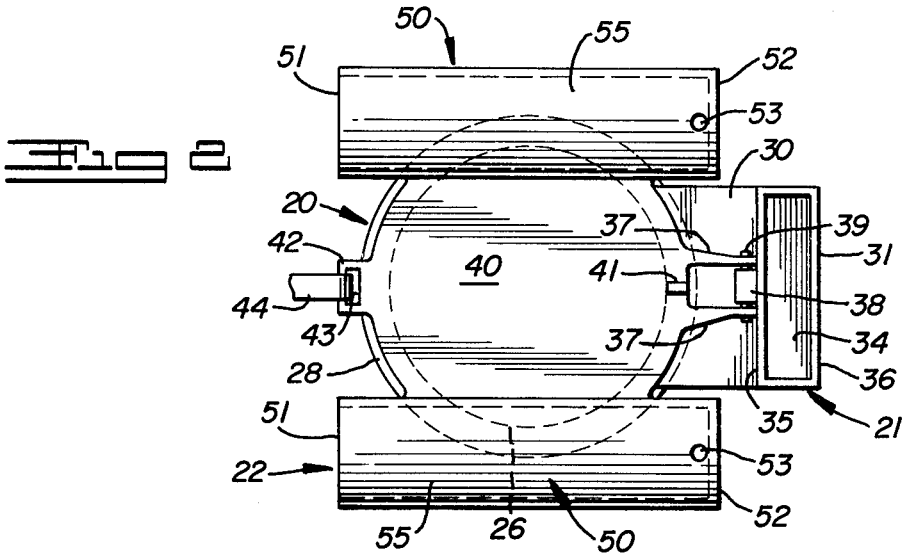
FIG. 2 is a plan view of the assembly.
Figure 3:
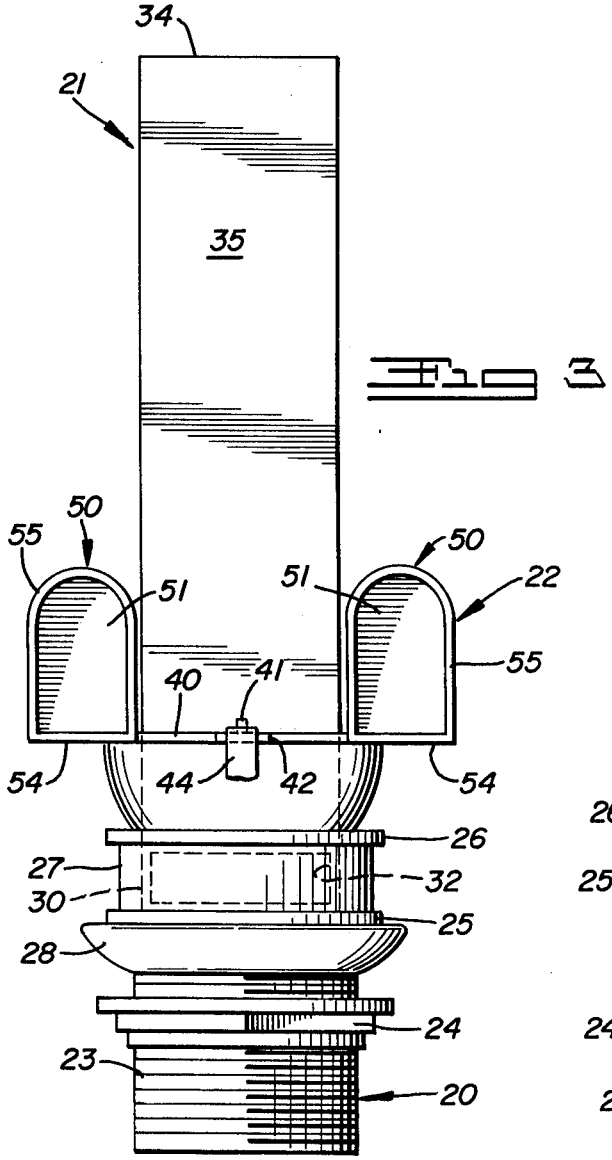
FIG. 3 is a side elevational view of the assembly showing the valve closed.

The valve-carrying unit 22 consists of a valve-support plate or disc 40 (FIG. 2) which is provided with a pair of angularly spaced outwardly extending pivot lugs 37 which straddle a lug 38 formed on the outer surface of the front wall 35 of the upstanding branch 31 of the overflow pipe. A transverse pivot pin 39 is passed through the lugs 37 and 38 to pivot the plate 40 for vertical swinging movement about a horizontal axis which is transverse of and at a right angle to the vertical axis of the branch 31 of the overflow pipe. On the outer or upper surface of the disc 40 at its peripheral edge and midway between the lugs 37 and 38 is a stop projection 41 which, in the raised position of the disc, is adapted to contact the front wall 35 of the pipe to determine the final raised position of the disc. Diametrically opposite the lug formation 37 and stop 41 is a radially-projecting lifting lug 42 which has a transverse slot 43 for receiving a lifting strap or band 44.

The lower or inner surface of the disc 40 carries a ball-type valve and float combination which is adapted to cooperate with the annular seat 33*a* at the upper end of the passage 33 of the fitting 20. This valve comprises a hemispherical rigid plastic float member 45 (FIG. 4) fixed to the bottom surface of the plate 40 and a covering or skirt member 46 also of substantially hemispherical form around the member 45 and which is made of flexible plastic or rubber. It will be noted that the skirt 46 is of a greater radius of curvature than that of member 45 so that there is a space 47 between the two members which permits flexing of member 46 relative to member 45 and also that there is a central opening 48 in the skirt 46 which allows water to flow into and out of the space 47. As will later appear, the member 45 will act as a float and the member 46 as a flexible valve for seating on the seat 33*a*.

The valve plate or disc 40 carries a pair of elongated water-receiving counterbalancing containers 50 (FIG. 2) of tubular form with their axis substantially tangential of the valve disc. These containers 50 are so disposed on the valve plate or disc that their axes extend outwardly from the axis of the pivot 39 and normal thereto, and in parallel relationship to each other and to the axis or diameter of the plate 40 which is normal to the pivot axis. The outer ends 51 (FIG. 1) of the containers are open, but their inner ends 52 are closed except for small metering discharge orifices or openings 53. The lower or inner walls 54 of the containers 50 are preferably in a common plane with the plate 40 and their opposite walls 55, which will be uppermost when the valve is closed, are of arched form. With the valve closed and the plate 40 in horizontal position, the respective metering openings 53 are at the upper outer or rear corners of the containers.

In operation, assuming the pivoted valve-carrying unit 22 is in its lowermost position, the valve will be closed, the tank 10 will be filled to the maximum level of the inlet 34 of the overflow pipe and the containers 50 will be filled with water. The weight of the unit 22 and the pressure of water in the tank will hold the valve seated, the skirt 46 flexing and conforming to the seat 33*a*. The band 44 will have some slack in it with the valve seated and it will be noted that its connection to the arm 15 will be by an adjustable clamp 15*a*.

To open the valve, the lever 14 is actuated to lift the unit 22 to swing it upwardly about the pivot 39. It is only necessary to start the lifting action since the member 45 will serve as a float and as the valve is unseated, will aid in lifting the unit. It will be noted that the containers 50 are located upwardly or outwardly of the pivot axis 39, but eventually as they move toward their final vertical position, they cause the center of gravity of the unit 22 to move beyond the pivot axis 39 to hold the unit in the vertical position shown in FIGS. 1 and 4, this final position being determined by stop 41 striking the inner face of wall 35 of the overflow pipe. The counterbalance effect of the filled containers 50 will thus act at this time to hold the valve open for a predetermined period to permit discharge of substantially all the flush water from the tank 10. It will be noted that in the upper position of unit 22, the pair of containers 50 will straddle the vertical part 31 of the overflow pipe and will not contact the back tank wall 13 even though the space behind the pipe is limited. However, as the water level in the tank lowers, the water from the containers 50 will gradually drain through the metering orifices 53. When substantially all of the water drains from the containers 50, the center of gravity of the unit 22 will be shifted forwardly beyond the pivot axis 39 so that the unit 22 will swing downwardly and again seat the valve.

It will be apparent that this invention provides an overflow pipe and flush valve assembly which can be readily mounted in a toilet tank and which will properly fit in the limited space therein. The valve will effectively seal the outlet when closed and will readily move to opened position when actuated where it will be held for a proper period to permit emptying of the flush tank. The overflow pipe is shaped to have desirable capacity while occupying a minimum of the limited space available and to support the valve-carrying unit so there will be no interference with the back wall of the tank. The use of two water containers to obtain the counterbalance effect is desirable since to provide one large container to obtain the same effect might result in interference with associated parts. Also, because the containers are at opposite sides of the pivoted valve unit, they balance each other laterally and, consequently, there will be no binding at the pivot. The provision of the combined float and ball valve provides for effective seating of the valve, due to the yieldable cover, and assurance that the valve will open due to the float. Furthermore, the rectangular cross-sectional shape and the disposition of the overflow pipe is important in conserving space and also in permitting the pivoted valve unit to swing back into open position sufficiently to keep it from falling down because of the pull of the water being released from the tank.

Having thus described the invention, what is claimed is:

1. A flush valve and overflow pipe assembly for mounting in a liquid storage tank in cooperation with a downwardlyopening discharge outlet including:

a fitting adapted to be mounted in cooperation with said outlet and having an upwardly opening discharge passage provided with a valve seat at the upper end of said fitting;

an elongated, upstanding overflow pipe carried by said fitting in radially offset relationship to the discharge passage, said overflow pipe having a lower end in fluid communication with the discharge passage and an inlet at its upper end; and a valve-carrying unit mounted on said overflow pipe for vertical swinging movement above said valve seat and comprising;

a valve member, a valve-supporting member having said valve member mounted thereon for cooperation with said valve seat and having an inner end pivoted to said overflow pipe to permit swinging movement about a horizontal axis between a lower horizontal position where the valve member is closed on said valve seat and a substantially upright position where the valve member is spaced upwardly from said valve seat, said valve-supporting member having an axis extending outwardly from and substantially normal to said pivot axis and horizontally disposed when in said lower horizontal position, and a pair of counterbalancing, liquid receiving containers carried by said valve-supporting member at opposite sides of the axis thereof and spaced apart a distance greater than the width of said overflow pipe so as to receive said pipe therebetween when said valve-supporting member is swung to its upright position, said containers being of elongated tubular form having longitudinal axis disposed parallel to each other and to the axis of said valve-supporting member but in relatively offset relationship thereto at the side opposite to said valve member with a liquid capacity to provide a counterbalancing force when filled to maintain said valve-supporting member in an upright position, each of said containers having the inner ends adjacent said pivot axis closed and the other ends open and having a relatively small liquid discharge opening formed therein at the closed end to permit discharge of liquid therefrom at a predetermined rate when said valve supporting member and container are in the upright position whereby enabling the valve-supporting member to return to the lower horizontal position as said containers become emptied.

2. An assembly according to claim 1 in which said valve member is of hemispherical form and depends from the lower side of said member for fitting into said seat when the member is in horizontal position.

3. An assembly according to claim 2 in which said valve is a combination float and valve having a rigid hemispherical member which will act as a float, and a flexible covering also of substantially hemispherical form, but of a greater curvature with an opening formed in the central portion thereof which projects into the discharge passage of said fitting.

4. An assembly according to claim 1 in which said overflow pipe is of rectangular cross-section having one of the wide sides thereof disposed inwardly toward the fitting with said valve-supporting member pivoted on said inwardly facing side.

5. An assembly according to claim 1 in which said overflow pipe is L-shaped having a lower radially extending branch connecting the passage of the fitting and the upstanding portion of said pipe.

6. An assembly according to claim 1 in which a stop is provided between said upstanding overflow pipe and said valvesupporting member to limit its upward swinging to said upright position.

7. An assembly according to claim 1 in which said valve-supporting member is a disc having said valve member depending from one side thereof and said liquid receiving containers disposed substantially tangentially on the other side of said disc.

8. An assembly according to claim 7 in which said disc forms a part of said liquid-receiving containers.

9. An assembly according to claim 7 which includes a flexible member connected to said disc at the peripheral edge thereof remote to the pivoted inner end for swinging it upwardly about said pivot axis.

* * * * *